US006360819B1

(12) United States Patent
Vinegar

(10) Patent No.: US 6,360,819 B1
(45) Date of Patent: Mar. 26, 2002

(54) ELECTRICAL HEATER

(75) Inventor: Harold J. Vinegar, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/256,877

(22) Filed: Feb. 24, 1999

Related U.S. Application Data

(60) Provisional application No. 60/075,739, filed on Feb. 24, 1998.

(51) Int. Cl.[7] ..... E21B 36/04
(52) U.S. Cl. ..... 166/60; 166/65.1
(58) Field of Search ..... 166/60, 57, 65.1, 166/302, 248

(56) References Cited

U.S. PATENT DOCUMENTS

| | | | | |
|---|---|---|---|---|
| 2,732,195 A | | 1/1956 | Ljunstrom | 262/3 |
| 4,127,169 A | * | 11/1978 | Tubin et al. | 166/250 |
| 4,437,518 A | * | 3/1984 | Williams | 166/248 |
| 4,513,815 A | * | 4/1985 | Rundell et al. | 166/57 |
| 4,640,352 A | | 2/1987 | Vanmeurs et al. | 166/245 |
| 4,704,514 A | * | 11/1987 | Van Egmond et al. | 219/278 |
| 4,886,118 A | | 12/1989 | Van Meurs et al. | 166/245 |
| 5,060,287 A | | 10/1991 | Van Egmond | 392/301 |
| 5,065,818 A | | 11/1991 | Van Egmond | 166/60 |
| 5,244,310 A | | 9/1993 | Johnson | 405/128 |
| 5,318,116 A | | 6/1994 | Vinegar et al. | 166/60 |

* cited by examiner

*Primary Examiner*—David Bagnell
*Assistant Examiner*—Zakiya Walker

(57) ABSTRACT

A well heater is provided, the heater effective for heating earth surrounding a wellbore from the wellbore, the well heater including: a) a resistive heating element, the resistive heating element traversing a segment of the wellbore to be heated; b) more than one ceramic insulators, the ceramic insulators defining a channel through which the resistive heating element passes; and c) a support element connected to at least one ceramic insulator, the support element effective for conducting heat from the ceramic insulator and radiating heat to the wellbore wall, and to support the weight of the electrical resistance element and the ceramic insulators through the connection to the at least one ceramic insulator. The wellbore heater of the present invention is easily fabricated from available materials, and provides a reliable and inexpensive wellbore heater.

10 Claims, 2 Drawing Sheets

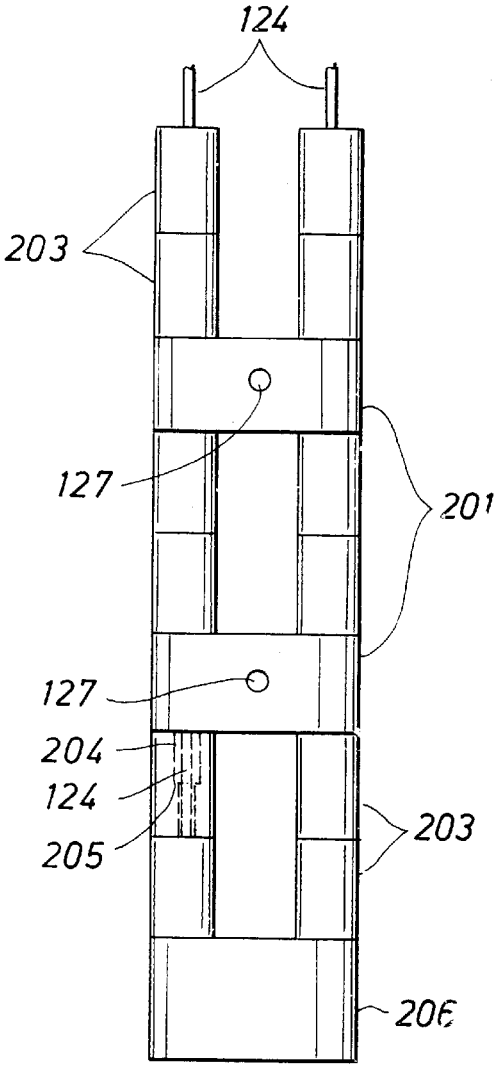
FIG. 2
FIG. 3
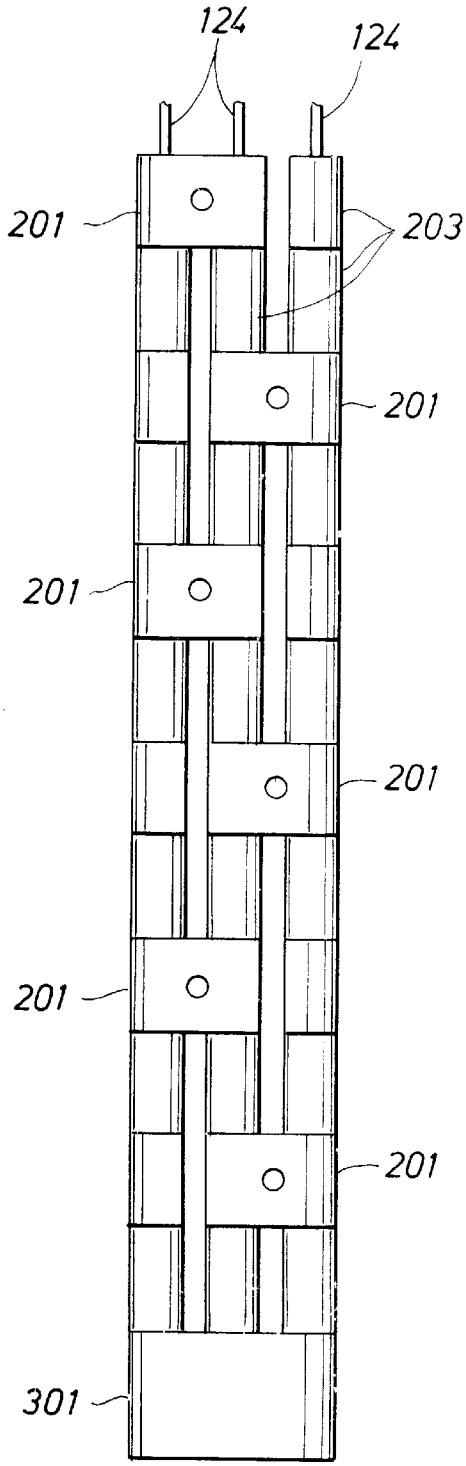

ELECTRICAL HEATER

This application claims the benefit of U.S. Provisional Application Ser. No. 60/075,739 filed Feb. 24, 1998, the entire disclosure of which is hereby incorporated by reference.

FIELD OF THE INVENTION

This invention relates to a high temperature electrical heating method and apparatus.

BACKGROUND TO THE INVENTION

U.S. Pat. Nos. 4,640,352 and 4,886,118 disclose conductive heating of subterranean formations of low permeability that contain oil to recover oil therefrom. Low permeability formations include diatomites, lipid coals, and oil shales. Formations of low permeability are not amiable to secondary oil recovery methods such as steam, carbon dioxide, or fire flooding. Flooding materials tend to penetrate formations that have low permeabilities preferentially through fractures. The injected materials bypass most of the formation hydrocarbons. In contrast, conductive heating does not require fluid transport into the formation. Oil within the formation is therefore not bypassed as in a flooding process. Heat injection wells are utilized to provide the heat for such processes.

Heat injection wells can also be useful in decontamination of soils. U.S. Pat. No. 5,244,310, for example, disclose a method for decontamination of soils wherein heat is injected below the surface of the soil in order to vaporize contaminates. The heater of patent '310 utilizes electrical resistance of spikes, with electricity passing through the spikes to the earth. Heating using the electrical resistance of elements which are in contact with contaminated soil results in a temperature profile which greatly depends upon the points at which current leaks to to the soil. Providing a uniform and predictable heat injection profile is therefore difficult.

U.S. Pat. No. 5,060,287 teaches an electrical resistance heater element for use in as a wellbore heater wherein the heating element is of a copper-nickel alloy, and is provided in a mineral insulated sheath. The copper-nickel alloy is particularly useful because the resistance as a function of temperature for this alloy is relatively flat. Thus, electrical resistance, and therefore heat release, at hot spots does not significantly increase. This cable heater design had disadvantages in that the surface area from which heat is transferred is small, and it is difficult to join segments of the heater cables to form spliced heater cables of significant length. It would be preferably to have a heater design which has a greater surface area from which to transfer heat, and which is easier to splice together long segments.

U.S. Pat. No. 2,732,195 discloses an electrical heater well wherein an "electrically resistant pulverulent" substance, preferably quartz sand or crushed quartz gravel, is placed both inside and outside of a casing of a wellbore heater. Heat must be transferred from the heater element to the casing conductively. It would be advantageous to provide such a heater wherein this heat could be transferred by radiation, which could significantly reduce the temperature difference required to transfer heat to the casing.

SUMMARY OF THE INVENTION

These and other objects are accomplished by a well heater effective for heating earth surrounding a wellbore from the wellbore, the well heater comprising: a) a resistive heating element, the resistive heating element traversing a segment of the wellbore to be heated; b) a plurality of ceramic insulators, the ceramic insulators defining a channel through which the resistive heating element passes; and c) a support element connected to at least one ceramic insulator, the support element effective for conducting heat from the ceramic insulator and radiating heat to the wellbore wall, and to support the weight of the electrical resistance element and the ceramic insulators through the connection to the at least one ceramic insulator.

The heater of the present invention may be utilized in applications such as soil remediation, recovery of oil from oil shales, tar sands, and diatomite formations. The heaters are simple, relatively inexpensive, and reliable. The support member preferably extends across at least 75% and more preferably at least 90% of the diameter of the well, so that heat conductively transferred from the heating elements through the ceramic insulators can be radiated to the inside surface of the wellbore from a greater surface area.

BRIEF DESCRIPTION OF THE DRAWINGS

FIG. 2 shows an insulator arrangement for two phase electrical power.

FIG. 3 shows an insulator arrangement for three phase electrical power.

DETAILED DESCRIPTION OF THE INVENTION

Figure 1:
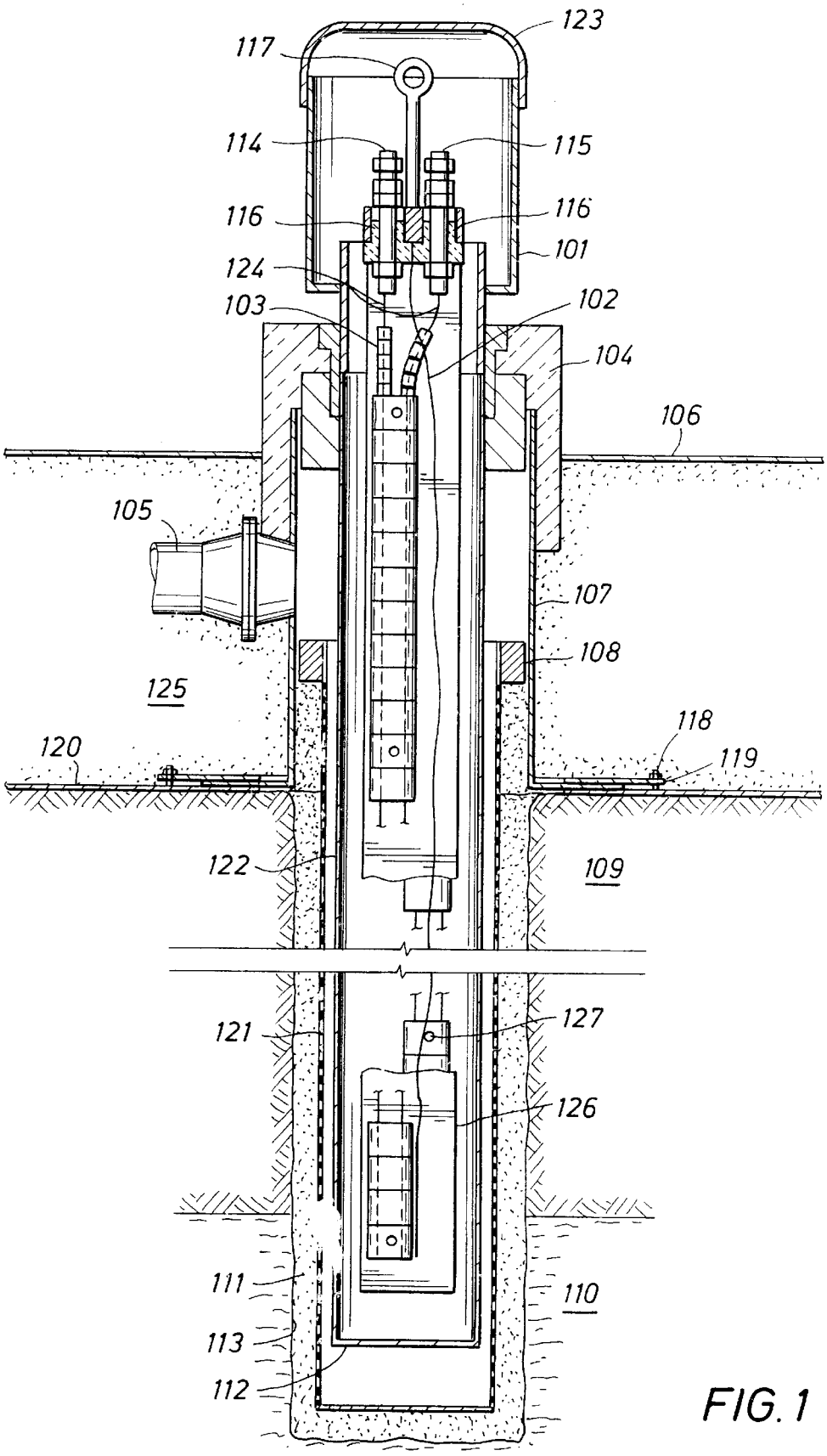
FIG. 1 shows a heating apparatus according to the present invention.

The heater of the present invention may be utilized in either a cased or an uncased wellbore. An uncased wellbore is less expensive to provide, and minimizes resistance to heat transfer to the earth surrounding the wellbore. But cased wellbores are preferred because of the protection from the elements of the wellbore provided by the casing. Further, the casing may be perforated to permit extraction of hydrocarbons or contaminates from the earth surrounding the wellbore through the heater wellbore.

The heating elements of the present invention may be any known electrically conductive material which retains sufficient strength at elevated temperatures. Nickel-chromium alloys such as "Nichrome-80" are preferred because of their high temperature corrosion resistance. Uninsulated elements are preferably utilized because the ceramic insulators of the present invention provide support and electrical isolation for the electrically resistive heating elements. Multiple heating elements may be provided in each well, or a single phase of, for example, a three phase electrical power supply could be provided. The heating elements may be single elements which are grounded at the lower extremity of the heater, or may be double or triple strands connected at the lower extremity of the wellbore.

The resistive heating elements are preferably at least 3 mm in diameter to provide adequate service life. The diameter, or thickness, of the resistive heating elements may be varied along the length of the heating element to provide more or less heat along the length of the heater. For example, it may be desirable to provide for more heat release near the top and the bottom of the heater to balance heat losses.

The ceramic insulators of the present may be simple hollow cylinders which may be strung onto the resistance elements and the hollow cylinders connected to the support by a clamp. The ceramic insulators may optionally be flat ceramic pieces with two or three holes through which the heating elements can be strung. A ceramic piece that has two holes for the heating elements and a hole perpendicular the axis of the heating element holes is preferred. Even if three heating elements are provided, it is preferable to provide ceramic insulators with only two holes because three hole ceramic pieces have been found to be more difficult to string on the heating elements. The ceramic may have interlocking protrusions along the axis of the heater element, with a male and a female end, allowing for expansion without exposing bear heater element. The two hole ceramic pieces could be used with the three heating elements by alternatively connecting the middle of three elements to the adjacent elements. The perpendicular hole is preferably utilized to attach the insulator to the support member by a bolt or other similar connector. Ceramic insulators with the holes for bolting to the support members could be provided, for example, every one to ten feet along the heater. The ceramic insulators are preferably between about one centimeter and about three centimeters in length each. Longer insulators may be utilized, but could be subject to leaving a longer length of heating element exposed if one of the ceramic pieces should break. Shorter pieces could also be useful, and could result in a more flexible heating element-insulator combination, but become unnecessarily expensive to assemble.

Friction between the inside of the channels and the resistive heating elements supports the weight of the resistive heating element. The metal resistive heating element will expand upon heating greater than the ceramic insulator, and thus, will be held tighter due to both length and diameter increases upon heating. A resistive heating element outside diameter of about 90% of the inside diameter of the channels within the ceramic insulators is preferred, and a diameter of 75% of the inside diameter of the channels is acceptable to provide support for the weight of the heating element by friction from the ceramic insulators. A smaller diameter heating element could be used, but another provision to support the weight of the heating element may be required. For example, a ceramic clamp may be provided, or a elbow may be bent in the resistive heating element so that the elbow sits on top of an anchored ceramic insulator.

The support element of the present invention is preferably a flat strip of metal which is sufficiently thick to support the weight of the heater below that point of the assembly. The metal preferably has good creep strength at high temperatures such as 310 stainless steel or "HR120". The thickness of the support element therefore depends on the weight and length of the heater, and operating temperature of the heater. The creep strength. must be sufficient so that the weight is supported for the required period of high temperature operation. The thickness of the support member can decrease down the length of the heater for a heater of extended length because less weight is supported.

Referring now to FIG. 1, a section of a heater well of the present invention is shown. Heater assembly 101 is placed on the wellhead 107. Thermocouple 102 is routed into the well for measurement of the temperature within-the well. Electrical power for heater elements 124 is provided through insulators 116 from electrical connections 114 and 115. Electrical element insulators 103, preferably ceramic insulators, provide for expansion of the elements while providing separation of the electrical elements. The insulators 103 are provided with holes 127 through which attachments to a support element 126 may be provided. The attachments may be, for example, pegs, bolts, or studs with cotter pins, and may be spaced so that the weight of the intervals between the connections to the support member can be self-supporting even at operating temperatures. This spacing may be, for example, every one to ten feet. Well head insulation 104 is provided to reduce heat loss from the top of the wellhead. Vacuum connection 105 provides communication from the inside of the wellhead to a vacuum source from which vaporized contaminates and water vapor is removed from the wellhead. Rain shield 106 is placed over thermal insulation 125 to prevent rain from getting to the thermal insulation and the soil being decontaminated. Preventing rain from getting to the soil being decontaminated is important in remediation by the method of the present invention because vaporization of a continuing influx of additional water greatly increases the energy input required, and could prevent temperatures of the soil to be decontaminated from reaching temperatures necessary for decontamination. Although insitu water is also often useful for reduction of the partial pressure of the contaminants and steam distillation of the contaminants from the contaminated soil, the amount of additional water added to the contaminated soil must generally be limited. If additional water is needed in the formation for additional steam distillation of the contaminants from the soil, the amount and distribution of this additional water must be controlled.

A pipe collar 108 supports a sand screen 121 inside of the wellbore. Sand 111 can be provided between the sandscreen and the soil to reduce the amount of soil drawn into the vacuum system.

Wellbore 113 penetrates contaminated soil 109 and additionally penetrates into native soil 110 to ensure that the contaminates are completely removed. End disk 112 is provided at the bottom of a removable heater can 122. A lifting eye 117 is provided to allow for installation and removal of the heater can from the wellbore. Cap 123 can be added over the electrical connections to help keep the electrical connections dry and to prevent the electrical connections from accidentally shorting.

Metal sheet 120 is spread over the surface of the soil to be remediated, and holes are then cut into the metal sheet for placement of the wells. Studs 118 can be used to clamp the wellhead 107 to the metal sheet with flange 119.

Referring now to FIG. 2, an alternate arrangement for the insulators 103 of the present invention is shown. Insulators 201 through which two heating elements 124 can pass are provided at intervals between plain spool insulators 203. The plain spool insulators are more easily strung on the relatively stiff heater elements 124, and are also generally less expensive than the insulators which have two holes for the heating elements. The insulators 201 through which both of the heating elements can pass may each have a hole 127 for attachment to the support member 126. The insulators may have male extensions 204 axial with the holes for the heating elements with mating female openings 205 to help prevent arcing of electricity from the heating element 124 to the support member 126. An end insulator 206 can be provided to provide an electrically insulated connection between the heater elements. Alternatively, the support member could be electrically grounded, and the end insulator may provide for electrical continuity between the heater elements.

Referring now to FIG. 3, and alterative arrangement of the embodiment of FIG. 2 for three phase alternating electrical current is shown. Because three heating elements can be difficult to string onto an insulator, the two element insulators 201 of FIG. 2 may be used in an alternating fashion between two of the three heating elements 124. Cylindrical spools 203 are used as fillers between the alternating two-heater element insulators. A three heater element connector insulator block 301 can be used, or alternatively, if the support element is grounded, all three elements could be clamped to the support element.

I claim:

1. A well heater effective for heating earth surrounding a wellbore from the wellbore, the well heater comprising:

a) at least one resistive heating element, the resistive heating element traversing a segment of the wellbore to be heated;

b) a plurality of ceramic insulators, each ceramic insulator defining at least one channel through which the resistive heating element passes; and c) a support element connected to at least one ceramic insulator, the support element effective for conducting heat from the ceramic insulator and radiating heat to the wellbore wall, and to support the weight of the resistance element and the ceramic insulators through the connection to the at least one ceramic insulator wherein the ceramic insulators support the resistive heating element by friction between the outside of the resistive heating element and the inside of the channel through which the resistive heating element passes.

2. The well heater of claim 1 wherein the ceramic insulators define two channels, and two elements pass through the ceramic insulators.

3. The well heater of claim 1 wherein the wellbore is a cased wellbore.

4. The well heater of claim 3 wherein the support element is a flat metal sheet which has a width of at least about 75% of the inside diameter of the wellbore casing.

5. The well heater of claim 4 wherein the support element is a flat metal sheet which has a width of at least about 90% of the inside diameter of the wellbore casing.

6. The well heater of claim 1 wherein the heating element is a bare metal wire.

7. The well heater of claim 1 wherein channels of the ceramic insulators are aligned to form an essentially continuous channel through which the electrical heating element passes.

8. The well heater of claim 1 wherein the ceramic insulators are connected to the support element by bolts passing through holes, the holes perpendicular to the axis of the resistive heating elements.

9. The well heater of claim 8 wherein each ceramic insulator is supported by the support element at intervals of about 5 feet or less.

10. The well heater of claim 8 wherein each ceramic insulator is supported by the support element at intervals of between about one and about ten feet.

* * * * *